United States Patent [19]

Wisecup et al.

[11] Patent Number: 4,670,950

[45] Date of Patent: Jun. 9, 1987

[54] THEFT-DETERRENT TAG

[75] Inventors: David R. Wisecup, Xenia; Jack D. Keefe, Dayton, both of Ohio

[73] Assignee: Monarch Marking Systems, Inc., Dayton, Ohio

[21] Appl. No.: 733,027

[22] Filed: May 13, 1985

[51] Int. Cl.[4] ..... A44B 9/00

[52] U.S. Cl. ..... 24/150 R; 24/155 BR; 24/160

[58] Field of Search ..... 24/150 R, 155 R, 155 BB, 24/155 RB, 160, 155 BR, 505, 506, 235, 510; 109/25; 292/307 R; 16/262, 263, 386, 304, 306–308; 116/202, 203, 212; 220/72, 89 A; 215/1 C, 1 R, 32; 70/276

[56] References Cited

U.S. PATENT DOCUMENTS

| | | | |
|---|---|---|---|
| 285,963 | 10/1883 | Brannen | 24/155 BR |
| 789,180 | 5/1905 | Spruce | 24/505 X |
| 875,379 | 12/1907 | Rainess et al. | 24/155 BR |
| 1,936,385 | 11/1933 | Ditatush | 109/25 |
| 2,572,940 | 10/1951 | Lockhart | 116/203 |
| 2,647,006 | 7/1953 | Coyle | 16/307 X |
| 2,658,363 | 11/1953 | Simmons | 24/510 X |
| 3,851,359 | 12/1974 | Wilson | 24/150 R X |
| 3,911,534 | 10/1975 | Martens et al. . | |
| 4,175,306 | 11/1979 | Bigelow et al. | 24/510 X |
| 4,187,509 | 2/1980 | Weiner . | |
| 4,221,025 | 9/1980 | Martens et al. . | |
| 4,280,256 | 7/1981 | de Jong . | |
| 4,299,185 | 11/1981 | Hefferman et al. | 116/212 X |
| 4,299,870 | 11/1981 | Humble | 24/161 X |
| 4,339,853 | 7/1982 | Lipschitz . | |
| 4,359,165 | 11/1982 | Jakobsen | 215/1 C |
| 4,483,049 | 11/1984 | Gustavsson et al. . | |
| 4,484,691 | 11/1984 | Lees | 220/89 A |
| 4,513,873 | 4/1985 | Klaschka | 220/89 A |

FOREIGN PATENT DOCUMENTS

| | | | |
|---|---|---|---|
| 649825 | 10/1962 | Canada | 137/797 |
| 288755 | 11/1915 | Fed. Rep. of Germany | 24/505 |
| 377481 | 9/1907 | France | 24/235 |
| 2282241 | 3/1976 | France | 24/265 WS |
| 482573 | 6/1954 | Italy | 16/262 |
| WO83/02975 | 9/1983 | PCT Int'Appl. | 109/25 |
| WO84/01847 | 5/1984 | PCT Int'l Appl. | 292/307 R |

*Primary Examiner*—Kenneth J. Dorner
*Assistant Examiner*—James R. Brittain
*Attorney, Agent, or Firm*—Joseph J. Grass

[57] ABSTRACT

There is disclosed a theft-deterrent tag including a pair of elongated tag members movable between open and closed positions relative to each other. The tag includes a pair of frangible stress-sensitive containers each containing dye. Attempted unauthorized removal of the tag will cause the dye to spill onto merchandise positioned between the tag members. Each container is secured to a respective tag member and flexure of the tag member causes fracture. The elongate tag members are movably connected at one end portion and releasably locked at the other end portion to enable the dye to spill on the merchandise and to shield the thief from the dye. An improved magnetically releasable lock can hold the tag members in the closed position.

6 Claims, 12 Drawing Figures

THEFT-DETERRENT TAG

BACKGROUND OF THE INVENTION

1. Field of the Invention

This invention relates to the field of theft-deterrent tags and fasteners.

2. Brief Description of the Prior Art

The following U.S. patents are made of record: U.S. Pat. No. 3,911,534 to H. J. Martens et al granted Oct. 14, 1975; U.S. Pat. No. 3,971,269 to M. A. J. Martens granted July 27, 1976; U.S. Pat. No. 4,187,509 to A. Weiner granted Feb. 5, 1980; U.S. Pat. No. 4,221,025 to H. J. Martens et al granted Sept. 9, 1980; U.S. Pat. No. 4,280,256 to H. J. de Jong granted July 28, 1981; U.S. Pat. No. 4,339,853 to H. Lipschitz granted July 20, 1982; and U.S. Pat. No. 4,483,049 to B. O. Gustavsson et al granted Nov. 20, 1984.

SUMMARY OF THE INVENTION

The invention relates to an improved theft-deterrent tag.

It is a feature of the invention to provide an improved theft-deterrent tag containing one or more frangible containers containing dye. In order to prevent the elongate tag member which houses the containers from being pryed open as with a clam shell, the tag members are movably connected one end portion and a releasable lock is connected at the other end portion.

It is a feature of the invention to provide an improved theft-deterrent tag having improved dye-holding containers composed of molded plastics material and being weakened at selected locations to facilitate fracture upon attempted unauthorized removal of the tag.

It is a feature of the invention to provide an improved theft-deterrent tag having dye-holding containers mounted by a tag member. The tag member has a pair of holding portions joined by a weakened portion. The container is held by the holding portions. Upon unauthorized attempted removal, the holding portions flex relative to each other which causes the container to fracture and spill dye onto the merchandise.

It is another feature of the invention to provide an improved theft-deterrent tag having a frangible dye-holding container composed of molded plastics material, wherein the container has one or more stress points which facilitate fracture of the container and spilling of the dye onto the merchandise.

It is a feature of the invention to provide an improved magnetically-releasable fastener or lock for a theft-deterrent device. The device includes a pair of rollers cooperable with a generally channel-shaped member having converging surfaces. The rollers are adapted to grip a pin to prevent release of the pin. A magnetizable member is spring-urged against the rollers to cause the rollers to be urged against the pin. When the fastener is brought into proximity to an appropriate magnet, the magnetizable member is drawn away from the rollers and the pin can be removed.

DESCRIPTION OF THE PREFERRED EMBODIMENT

Figure 1:
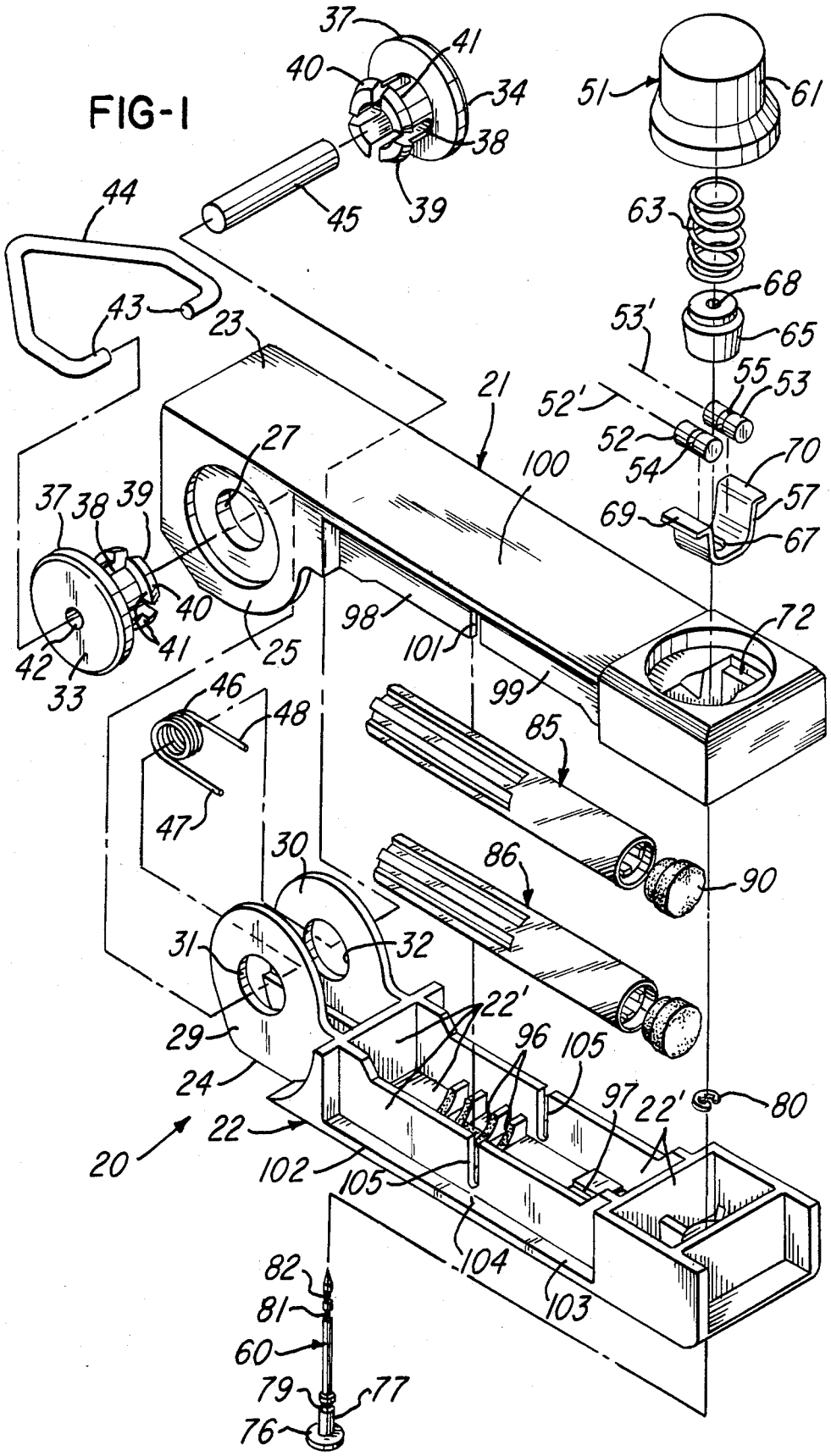
FIG. 1 is an exploded perspective view of a theft-deterrent tag in accordance with an embodiment of the invention.
Figure 2:
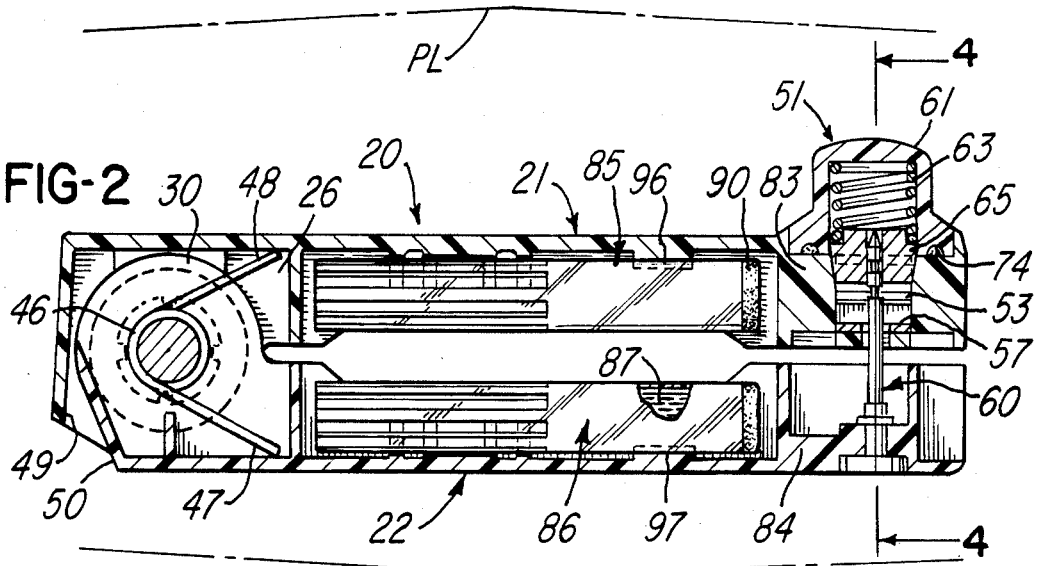
FIG. 2 is a sectional view of the assembled tag in a closed position.

With reference to FIG. 1, there is shown a theft-deterrent tag generally indicated at 20. The tag 20 is shown to include a pair of tag members generally indicated at 21 and 22. The tag members 21 and 22 are movably connected to each other at one end portions 23 and 24, preferably for limited movement. It is preferred that the tag members 21 and 22 pivot relative to each. The tag member 21 includes a pair of spaced wall members 25 and 26 (FIGS. 1, 2 and 3) with axially aligned holes 27 and 28. The tag member 22 has a pair of spaced wall members 29 and 30 with axially aligned holes 31 and 32. In the assembled condition, as in FIG. 2, the holes 27, 28, 31 and 32 are axially aligned with each other. Identical one-piece molded plastics connectors or fasteners 33 and 34 connect respective pairs of wall members 25 and 29, and 26 and 30. Each connector 33 and 34 has a head 37 joined to a shaft or pivot 38. Each shaft 38 is split and terminates at teeth 39. The teeth 39 have tapered entries 40 and abutment faces 41. The shafts 38 are received in respective pairs of holes 27 and 31, and 28 and 32. The tapered entries 40 and the splits in the shafts 38 enable the fasteners 33 and 34 to be resiliently and easily inserted, but the abutment faces 41 are at right angles to the axis of the shaft 38 and make it impossible to remove the fasteners 33 and 34 when the tag members 22 and 23 are in the closed position relative to each other. Aligned holes 42 in fasteners 33 and 34 receive aligned end portions 43 of a bail or hanger 44. Each shaft 38 is generally tubular and receives a pin 45. A spiral spring 46 received about the pin 45 has an end portion 47 acting against the tag member 22 and an end portion 48 acting against the tag member 21 as best shown in FIG. 2. The spring 46 normally urges the tag members 21 and 22 to an open position, wherein the tag members 21 and 22 form approximately a 30° angle relative to each other. End portion 49 (FIG. 2) on the tag member 21 contacts an abutment face 50 on the tag member 22 to define the open position of the tag 20.

Figure 4:
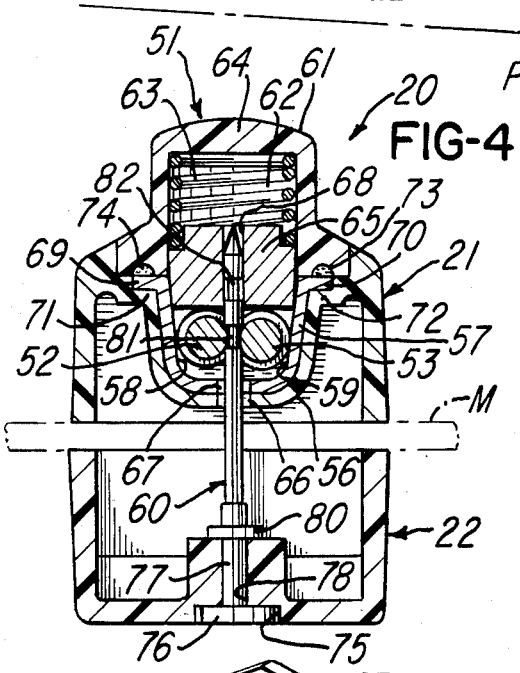
FIG. 4 is a sectional view taken along line 4—4 of FIG. 2 showing a thin piece of merchandise between the tag members.
Figure 5:
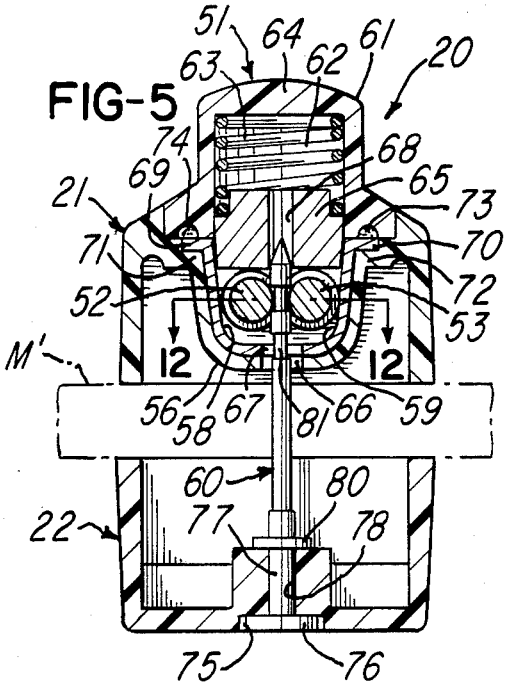
FIG. 5 is a sectional view similar to FIG. 5, but showing a thick piece of merchandise between the tag members.

A releasable fastener or lock generally indicated at 51 is shown to include a pair of rolls or rollers 52 and 53 having respective aligned grooves 54 and 55. The rollers have aligned parallel axes 52' and 53'. As best shown in FIG. 5, the tag member 21 has a generally channel-shaped or U-shaped member or portion 56 with a liner in the form of a channel-shaped or U-shaped member 57 supported hereby. The member 57 is formed of metal and (like the member 56) has inclined surfaces 58 and 59 which cooperate with respective rollers 52 and 53 to cam the rollers 52 and 53 toward each other into gripping relation with respect to a pin generally indicated at 60. The pin 60 is gripped at the nip of the rollers 52 and 53. The tag member 21 includes a cap 61 having a hole 62 for receiving a compression spring 63. The spring 63 bears against head or end wall 64 of the cap 61 and against a plunger 65. The plunger 65 is composed of magnetizable material and bears against the rollers 52 and 53 as best shown in FIGS. 2, 4 and 5. There is enough clearance between the plunger 65 and the hole 62 and the surfaces 58 and 59 to enable the plunger 65 to transmit the force of the spring 63 to the rollers 52 and 53.

The members 56 and 57 and the plunger 65 have aligned holes 66, 67 and 68 to allow movement of the pin 60. The member 57 has a pair of flanges 69 and 70 disposed on respective ledges 71 and 72. The cap 61 has an annular groove 73 which receives a permanent settable adhesive 74 which holds the cap 61 in place against the ledges 71 and 72 and against the flanges 69 and 70.

The pin 60 is anchored to the tag member 22 as best shown in FIGS. 2, 4 and 5. The tag member 22 has a recess 75 which receives head 76 of the pin 60. The pin 60 has an enlarged shank 77 which passes through a hole 78 in the tag member 22. The shank 77 has a groove 79 (FIG. 1) for receiving an E-ring 80. The pin 60 has a pair of axially spaced annular peripheral grooves 81 and 82. The pin 60 can be inserted to the position shown in FIG. 4 through thin merchandise M, in which event the rollers 52 and 53 are received in the groove 81, or the pin 60 can be inserted to the position shown in FIG. 5 through thick merchandise M′, in which event the roller 52 and 53 are received in the groove 82. In that the rollers 52 and 53 have aligned grooves 54 and 55, the rollers 52 and 53 partially encircle the pin 60 at either the groove 81 or the groove 82. As shown, the pin 60 provides the dual function of holding the tag 20 onto the merchandise M or M′ and of forming part of the fastener 51 which releasably locks the tag members 21 and 22 to each other. As shown, the fastener 51 is disposed at the other end portions 83 and 84 of respective elongate tag members 21 and 22.

The tag members 21 and 22 mount containers 85 and 86 which contain a dye 87′, preferably a liquid dye. The containers 85 and 86 are identical so only the container 85 is shown in detail in FIGS. 6 through 10. The container 85 is shown to have a generally tubular elongate portion or tube 87 and is closed at one end by an end wall 88. The other end of the tube 87 is open as indicated at 89 but is sealed by a plug 90 composed of settable adhesive such as epoxy. One portion 91 of the tube 87 has longitudinally extending, external, peripherally-spaced grooves 92. Another portion 93 of the tube 87 has longitudinally extending, internal, peripherally-spaced grooves 94. The grooves 92 and 94 are offset or peripherally spaced from each other, but the grooves 92 and 94 are overlapped at a generally central or overlapped portion 95 in the longitudinal direction of the tube 87. Each of the grooves 92 and 94 weakens the tube 87 and facilitates fracture of tube 87, but the tube 87 is weakest at the overlapped portion 95. The containers 85 and 86 are secured at portions 91 to the respective tag members 21 and 22 by adhesive 96 shown by stippling. The portions 93 of the tubes 87 are unsecured or cantilevered, except the tag members 21 and 22 have respective members 96 and 97 which contact the external surfaces of the tubes 87. The tag member 21 has relatively rigid sections or portions 98 and 99 joined by a weakened section or hinge 100 adjacent grooves 101. The sections 98 and 99 thus will deflect about the hinge 100. Likewise, the tag member 22 has relatively rigid sections or portions 102 and 103 joined by a weakened portion or hinge 104 adjacent grooves 105. Attempted removal of the tag 20 as by prying the tag members 21 and 22 apart will cause deflection of the sections 98 and 99 of the tag member 21 about hinge 100 and breakage of the container 85 and will cause deflection of the sections 102 and 103 of the tag member 22 about hinge 104 and breakage of the container 86. The tag member 21 deflects as shown by the upper phantom line PL and the tag member 22 deflects into a shape as shown by the lower phantom line PL as seen in FIG. 2. This causes the gap between the members 21 and 22 to become diamond-shaped so that the tool used to pry the members 21 and 22 apart is cammed toward the central portion 95 where the containers 85 and 86 are the weakest. Breakage of either or both containers 85 or 86 will cause the dye 87′ therein to spill onto the merchandise M or M′ to leave a telltale indication of unauthorized attempted removal. The grooves 92 and 94 provide stress points which weaken the containers 85 and 86 and facilitate breakage or rupture thereof upon attempted removal without releasing the fastener 51. Also, the grooves 92 and 94 preferably are sharp as shown, which cause stresses to develop as the tube 87 is molded.

As shown, the members 21 and 22 have a shell-like essentially continuous walls 21′ and 22′ which confine the spread of the dye 87′ mainly if not entirely to the merchandise M or M′ so that preferably little or no dye is spilled on the thief. Also connecting the tag members 21 and 22 of both opposite end portions 23 and 24, and 83 and 84 prevents the tag members 21 from opening like a clam shell, and therefore the thief is not in the path of the fracturing container 85 and/or 86 or the dye 87′.

Figure 3:
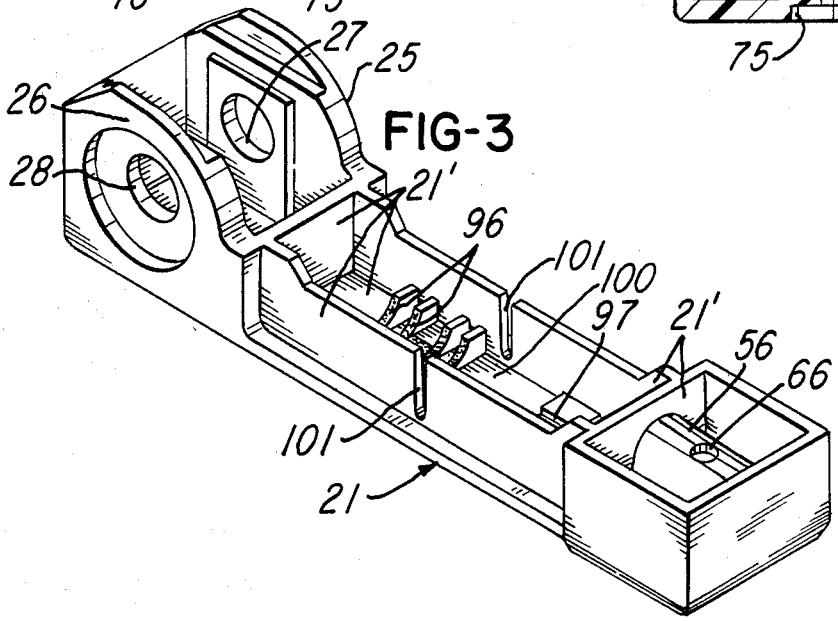
FIG. 3 is a perspective view of one of the tag members of the tag shown in FIGS. 1 and 2.
Figure 6:
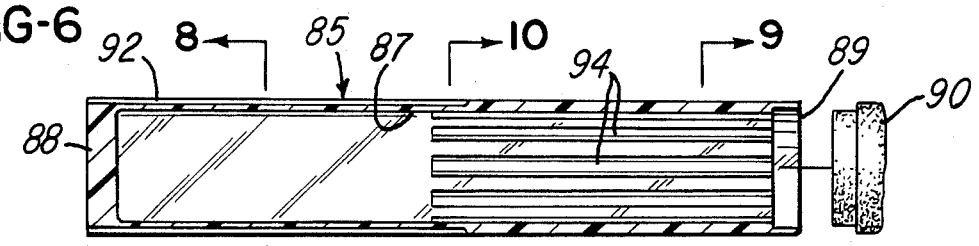
FIG. 6 is a sectional view through one of the containers of the tag, but without dye therein.
Figure 7:
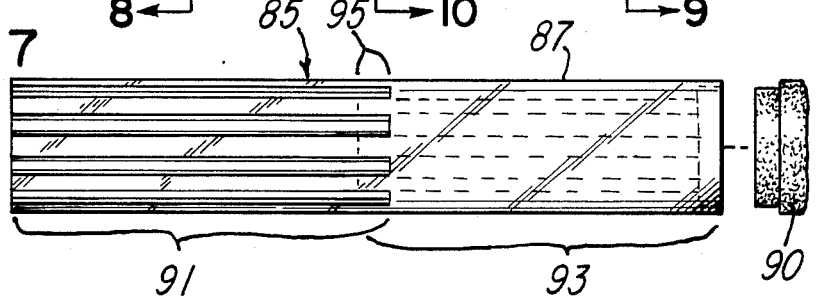
FIG. 7 is an elevational view of the container shown for example in FIG. 6.
Figure 8:
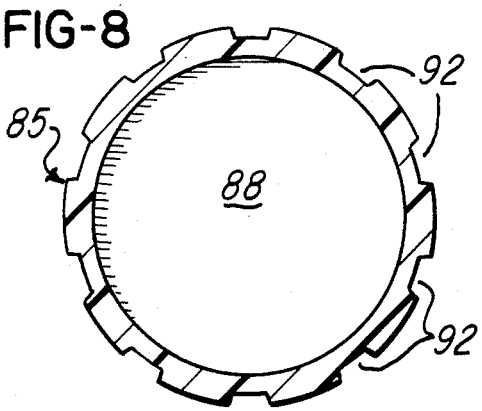
FIG. 8 is a sectional view taken along line 8—8 of FIG. 6.
Figure 9:
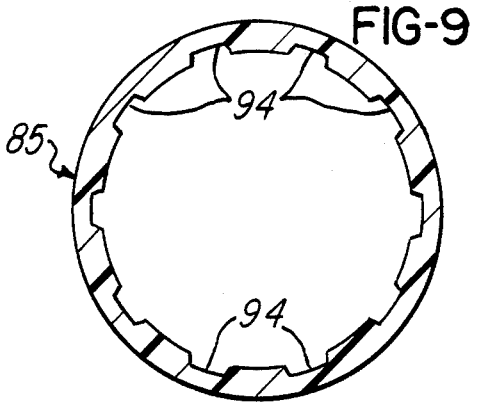
FIG. 9 is a sectional view taken along line 9—9 of FIG. 6.
Figure 10:
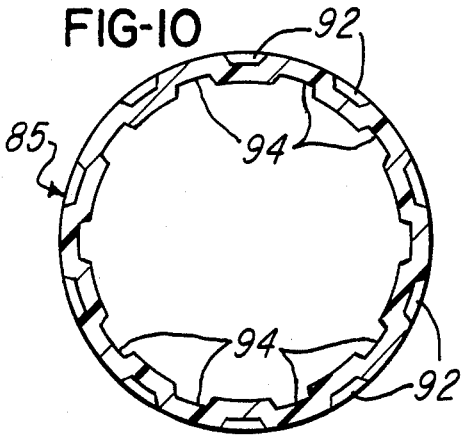
FIG. 10 is a sectional view taken along line 10—10 of FIG. 6.
Figure 11:
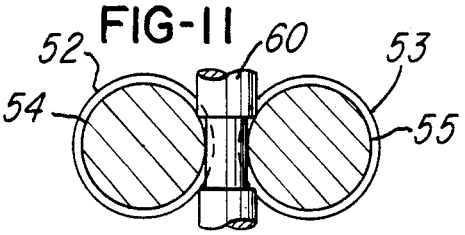
FIG. 11 is an enlarged fragmentary view showing the cooperation of the rollers and the pin.
Figure 12:
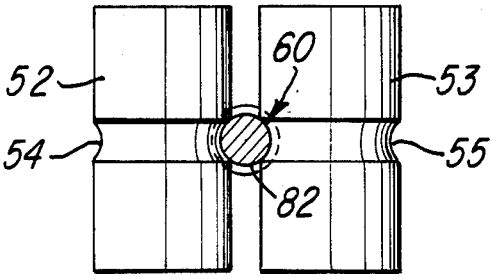
FIG. 12 is an enlarged sectional view taken along line 12—12 of FIG. 5

In using the tag 20, merchandise M or M′ is placed between the tag members 21 and 22 while in the open position. The tag member 21 and 22 act like jaws which can be moved to a closed position (FIGS. 2, 3 and 4). In closing on the merchandise M or M′, the pin 60 passes through the merchandise and passes through holes 66 and 67 and to between rollers 52 and 53 and into the hole 68. Irrespective of whether rollers 52 and 53 come to rest in the groove 81 or the groove 82, the tag members 21 and 22 cannot be moved to the open position without releasing the fastener 51. This can be accomplished at the check out counter by positioning the cap 61 into cooperation with a magnetic decoupler as disclosed for example in U.S. Pat. No. 4,339,853. The decoupler pulls the plunger 65 away from the rollers 52 and 53 against the action of the spring 63 so that the rollers 52 and 53 can move out of gripping relationship with respect to the pin 60. When the fastener 51 is thus released, the spring 46 moves the tag members 21 and 22 to the open position. The tag 20 is reusable many times until one or both of the containers 85 and 86 is broken by unauthorized removal.

Other embodiments and modifications of the invention will suggest themselves to those skilled in the art, and all such of these as come within the spirit of this invention are included within its scope as best defined by the appended claims.

We claim:

1. A theft-deterrent tag, comprising: a pair of connected elongate tag members, the tag members being relatively movable between open and closed positions, the tag being capable of receiving merchandise to be protected between the tag members to prevent separation of the tag and the merchandise while the tag members are in the closed position, means for releasably holding the tag members in the closed positions and for holding the tag to the merchandise, an elongate frangible container mounted on at least one of the tag members, a dye in the container, wherein the container-mounting tag member has at least two container-contacting sections and a weakened section hingedly connecting the container-contacting sections, wherein the container will break and release the dye onto the merchandise upon excessive deflection of a container-contacting sections about the weakened section during attempted removal of the tag without releasing the holding means, wherein the container includes weakening means for preferentially initiating fracture at the location of the weakening means, and wherein the weakening means of the container is adjacent the weakened section of the container-mounting tag member.

2. A theft-deterrent tag, comprising: a pair of tag members, each tag member having first and second walls with aligned holes, means for providing first holes in the first walls, means for providing second holes in the second walls, a first pivot member having a first pivot portion received in the first holes of the first walls, a second pivot member having a first pivot portion received in the second holes of the second walls, a shaft received in each pivot member, a theft-deterrent device mounted by one of the tag members, the tag being capable of receiving merchandise to be protected between the tag members to prevent separation of the tag and the tag members to prevent separation of the tag and the merchandise while the tag members are in the closed position, means for releasably holding the tag members in the closed position and for holding the tag to the merchandise, and a spiral spring received about the shaft for urging the tag members to the open position.

3. A theft-deterrent tag, comprising: a pair of tag members, each tag member having first and second walls with aligned holes, means for providing first holes in the first walls, means for providing second holes in the second walls, a first pivot member having a first pivot portion received in the first holes of the first walls, a second pivot member having a first pivot portion received in the second holes of the second walls, wherein the first and second pivot members comprise non-removable snap fasteners with each said pivot portion comprising a plurality of resilient depending legs, each leg terminating in a locking pawl, wherein the legs of said first and second snap fasteners extend through the first and second holes respectively and said locking pawls engage the periphery of the holes thereby preventing removal of said snap fasteners, a theft-deterrent device mounted by one of the tag members, the tag being capable of receiving merchandise to be protected between the tag members to prevent separation of the tag and the tag members to prevent separation of the tag and the merchandise while the tag members are in the closed position, and means for releasably holding the tag members in the closed position and for holding the tag to the merchandise.

4. A theft-deterrent tag as defined in claim 3, wherein each pivot member has an external hole, and a ball having end portions received in the holes of the first and second pivot members.

5. A theft-deterrent tag as defined in claim 3, including a shaft received in each pivot member, and a spiral spring received about the shaft for urging the tag members to the open position.

6. A theft-deterrent tag defined in claim 3, including means for limiting the opening movement of the tag members relative to each other.

* * * * *

UNITED STATES PATENT AND TRADEMARK OFFICE

CERTIFICATE OF CORRECTION

PATENT NO. : 4,670,950

DATED : June 9, 1987

INVENTOR(S) : David R. Wisecup and Jack D. Keefe

It is certified that error appears in the above-identified patent and that said Letters Patent are hereby corrected as shown below:

Cover sheet, right-hand column, line 24, "elongated" should be --elongate--. Column 1, line 29, after "connected" --at-- has been omitted. Column 6, line 30, "ball" should be --bail--.

Signed and Sealed this

Third Day of November, 1987

*Attest:*

DONALD J. QUIGG

*Attesting Officer*

*Commissioner of Patents and Trademarks*